US012595736B2

(12) United States Patent
Dodds

(10) Patent No.: US 12,595,736 B2
(45) Date of Patent: Apr. 7, 2026

(54) HIGH CAPACITY ROCK BOLT

(71) Applicant: FCI Holdings Delaware, Inc., Wilmington, DE (US)

(72) Inventor: Anthony Dodds, New South Wales (AU)

(73) Assignee: FCI Holdings Delaware, LLC, Wilmington, DE (US)

( * ) Notice: Subject to any disclaimer, the term of this patent is extended or adjusted under 35 U.S.C. 154(b) by 174 days.

(21) Appl. No.: 18/292,963

(22) PCT Filed: Jul. 28, 2022

(86) PCT No.: PCT/US2022/038625

§ 371 (c)(1),
(2) Date: Jan. 29, 2024

(87) PCT Pub. No.: WO2023/009692

PCT Pub. Date: Feb. 2, 2023

(65) Prior Publication Data

US 2024/0376822 A1 Nov. 14, 2024

(30) Foreign Application Priority Data

Jul. 30, 2021 (AU) ..... 2021104741

(51) Int. Cl.
*E21D 21/00* (2006.01)

(52) U.S. Cl.
CPC ..... *E21D 21/0033* (2013.01); *E21D 21/004* (2013.01)

(58) Field of Classification Search
CPC ..... E21D 21/0033; E21D 21/004
See application file for complete search history.

(56) References Cited

U.S. PATENT DOCUMENTS

| | | | | |
|---|---|---|---|---|
| 4,312,604 | A * | 1/1982 | Fu | E21D 21/004 405/259.3 |
| 4,382,719 | A | 5/1983 | Scott | |
| 7,367,751 | B2 * | 5/2008 | Vosbikian | E21D 21/004 405/259.3 |
| 8,714,883 | B2 | 5/2014 | Rataj | |
| 9,863,248 | B2 * | 1/2018 | Moon | E21D 21/004 |
| 10,837,280 | B2 | 11/2020 | Rataj et al. | |
| 2008/0075539 | A1 | 3/2008 | Vosbikian | |
| 2016/0312610 | A1 | 10/2016 | Moon | |

FOREIGN PATENT DOCUMENTS

| | | | |
|---|---|---|---|
| AU | 2004203853 | A1 | 3/2005 |
| WO | 2018157198 | A1 | 9/2018 |

* cited by examiner

*Primary Examiner* — Janine M Kreck
(74) *Attorney, Agent, or Firm* — The Webb Law Firm

(57) ABSTRACT

A friction bolt (10) includes a first generally circular tube (12) having an internal diameter and defining a longitudinal split, the tube being radially expandable. The bolt has a first leading end (16) for insertion into a borehole (50), a second end defining a head (18), and a second generally circular tube defining a longitudinal split and having an external diameter which is substantially the same as or larger than the internal diameter of the first generally circular tube. The second tube is located inside the first tube (12) with an exterior of the second tube in contact with the interior of the first tube (12). The friction bolt (10) is installed in a rock face (80) using standard friction bolt (10) installation equipment and methods.

5 Claims, 5 Drawing Sheets

10
14
30

10
12
16
30

18
12
10
14
20

30
30

16
10

40
42
18
12
10
20

40
42
40

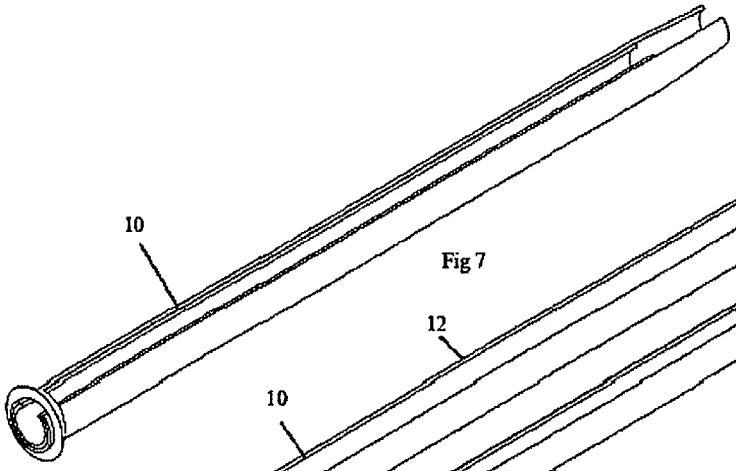
Fig 7
Fig 8
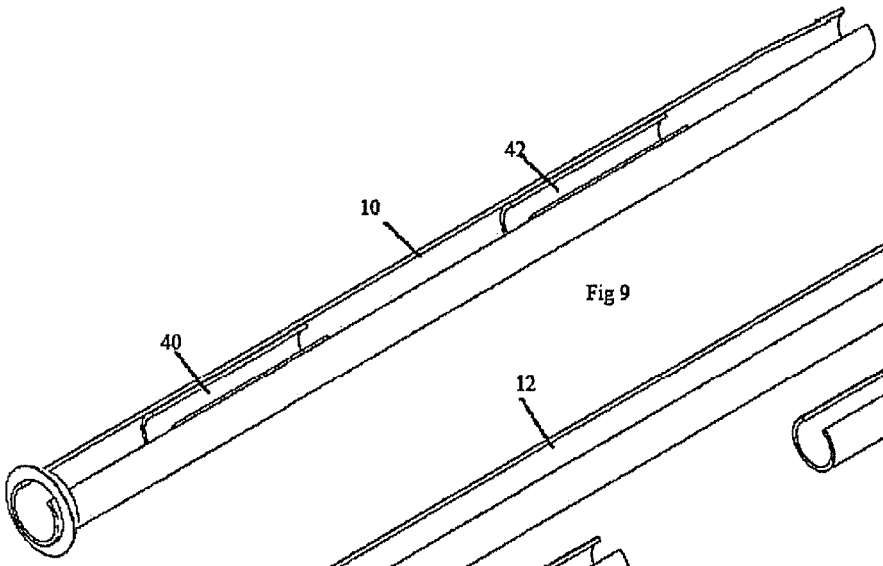
Fig 9
Fig 10

HIGH CAPACITY ROCK BOLT

CROSS REFERENCE TO RELATED APPLICATIONS

This application is the United States national phase of International Patent Application No. PCT/US22/38625 filed Jul. 28, 2022, and claims priority to Australian Innovation patent application No. 2021104741 filed Jul. 30, 2021, the disclosures of which are hereby incorporated by reference in their entireties.

BACKGROUND OF THE INVENTION

Field of the Invention

This invention relates to rock bolts and in particular to a friction bolt, also known as friction lock bolts or split set bolt.

Description of Related Art

Rock bolts are used in rock strata for the purpose of stabilizing the strata. One type of rock bolt commonly used in hard rock mines is known as a friction bolt. This type of bolt comprises a tube, typically made of steel, that is split longitudinally and which, in use, is forced into a bore, drilled into rock strata which is marginally smaller than the diameter of the tube. The tube becomes compressed so that the external surface of the tube engages the internal surface of the bore, anchoring the rock bolt inside the bore by friction forces.

Friction bolts are relatively cheap to manufacture and are easy to use compared with some other types of rock bolts which often require resin or cement to lock them into the bore. However, friction bolts do have a number of drawbacks. One significant drawback is the tendency for friction bolts to slip from the bore when a sufficiently large force is applied to the bolt.

In recent years, there has been an increasing demand for friction bolts which are resistant to larger pull out forces and have the capacity to resist higher pull out forces/loads.

One attempted solution is known as a stiff split set bolt. A series of pre-filled grout socks are inserted into the friction bolt which, once cured, are said to improve the pull out strength of the friction bolt. As well as increasing costs, this complicates the installation process.

Any discussion of documents, acts, materials, devices, articles or the like which has been included in the present specification is not to be taken as an admission that any or all of these matters form part of the prior art base or were common general knowledge in the field relevant to the present disclosure as it existed before the priority date of each of the appended claims.

SUMMARY OF THE INVENTION

According to a broad aspect of the present invention, there is provided an insert for location in a friction bolt. The insert will typically comprise a generally circular tube defining a longitudinal split and having a longitudinal axis.

Typically, the friction bolt will comprise a generally circular tube defining a longitudinal split and a longitudinal axis, the tube being radially expandable, the bolt having a first leading end for insertion into a bore and a second end defining a head.

The inner tube should be a snug fit within the friction bolt and contact the interior walls of the friction bolt.

The invention also provides a friction bolt comprising a first generally circular tube having an internal diameter and defining a longitudinal split, the tube being radially expandable, the bolt having a first leading end for insertion into a bore and a second end defining a head and wherein a second generally circular tube defining a longitudinal split and having an external diameter which is substantially the same as or larger than the internal diameter of the first generally circular tube, is located inside the first tube with its exterior in contact with the interior of the first tube.

It is preferred that the longitudinal splits defined in the first and second tubes are substantially aligned.

The inner tubes/inserts may be provided in different lengths for different load outcomes.

In one embodiment, the insert may extend substantially the entire length of the friction bolt.

In another embodiment, two or more inserts may be provided which are less than half the length of the friction bolt.

In a related aspect, there is provided a method of installing a friction bolt into rock comprising the steps of:

- providing a friction bolt comprising a first generally circular tube having an internal diameter and an external diameter defining a longitudinal split, the tube being radially expandable, the bolt having a first leading end for insertion into a bore and a second end defining a head;
- inserting one of more inserts into the bore of the friction bolt, each insert comprising a second generally circular tube defining a longitudinal split and having an external diameter which is substantially the same as or larger than the internal diameter of the first generally circular tube located with its exterior in contact with the interior of the first tube;
- drilling a borehole into the rock, the borehole having an internal diameter which is smaller than the external diameter of the friction bolt; and
- inserting the friction bolt into the borehole using force to compress the first tube and the insert to create radial pressure on the walls of the bore.

The friction bolt may be provided with the insert or inserts pre-installed in the first tube. The inserts may be fixed in place in the first tube or may be retained in place by friction.

Advantageously, the insert/second tube provides increased resistance to pull out forces with a cost effective solution with minimal additional components and without requiring the use of resin packages, providing a simple and inexpensive solution which is simple to implement. Advantageously, the method of installation is the same as that of a standard friction bolt and no additional steps are required during installation, such as the activation of resin packages or the like.

Throughout this specification, the word "comprise", or variations such as "comprises" or "comprising", will be understood to imply the inclusion of a stated element, integer or step, or group of elements, integers or steps, but not the exclusion of any other element, integer or step, or group of elements, integers or steps.

BRIEF DESCRIPTION OF THE DRAWINGS

Specific embodiments of the invention will now be described, by way of example only, and with reference to the accompanying drawings, in which:

FIG. 7 shows an isometric view of the first embodiment of a friction bolt including a full length insert shown in FIG. 1;

FIG. 8 shows an isometric view of the embodiment shown in FIG. 7 but with the insert and the friction bolt shown separately;

FIG. 9 shows an isometric view of a second embodiment of a friction bolt including a plurality of inserts embodying the present invention;

FIG. 10 shows an isometric view of the embodiment shown in FIG. 9 but with the inserts and the friction bolt shown separately;

DESCRIPTION OF THE INVENTION

Figures 1A, 1B, 2A, 2B, 3A, 3B, 4A, 4B, 5A, 5B, 6A, 6B:
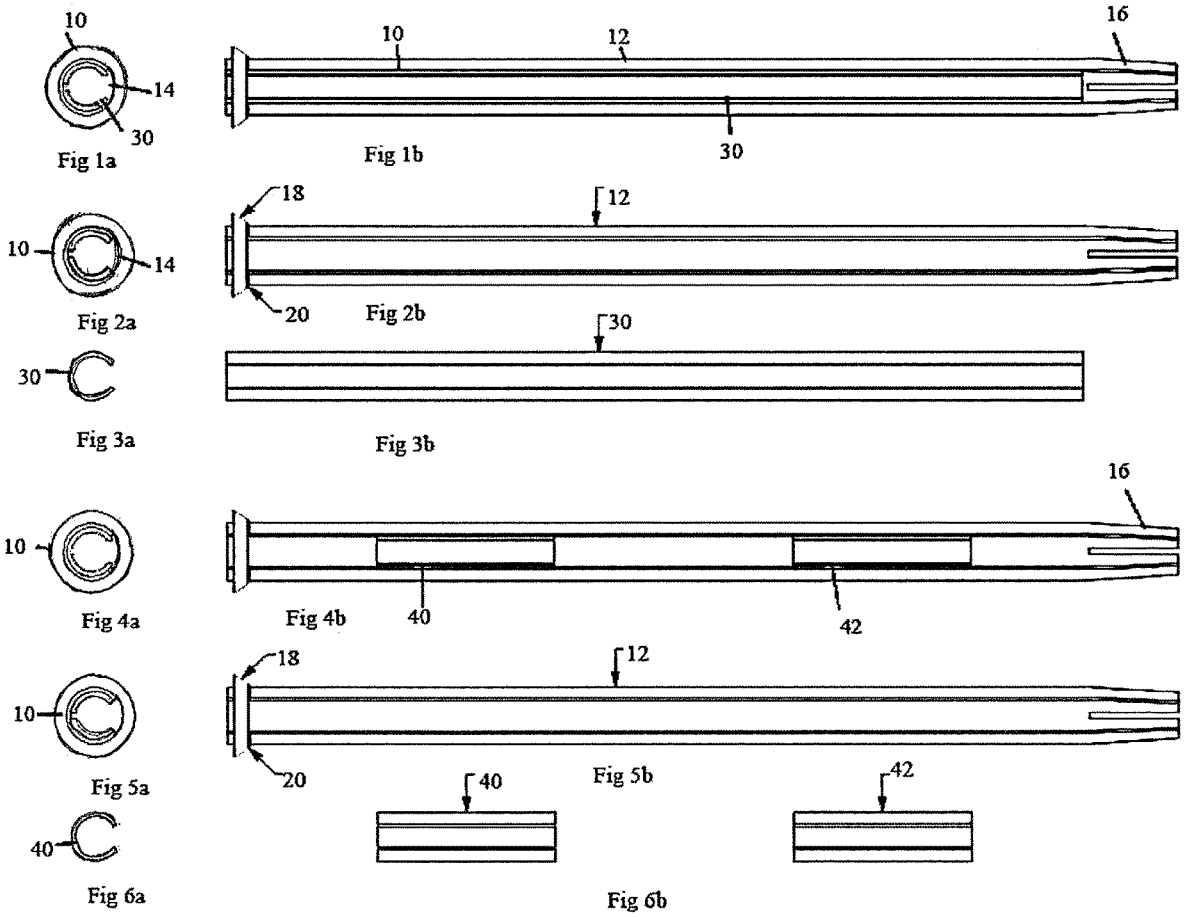
FIGS. 1*a* and 1*b* show an end view and a side view respectively of a first embodiment of a friction bolt including a full length insert embodying the present invention.
FIGS. 2*a* and 2*b* show an end view and a side view respectively of a the friction bolt only shown in FIGS. 1*a* and 1*b;*
FIGS. 3*a* and 3*b* show an end view and a side view respectively of the insert only shown in FIGS. 1*a* and 1*b;*
FIGS. 4*a* and 4*b* show an end view and a side view respectively of a second embodiment of a friction bolt including two inserts embodying the present invention.
FIGS. 5*a* and 5*b* show an end view and a side view respectively of a the friction bolt only shown in FIGS. 4*a* and 4*b;*
FIGS. 6*a* and 6*b* show an end view and a side view respectively of the inserts only shown in FIGS. 4*a* and 4*b;*

The drawings show a friction bolt 10. The friction bolt 10 includes an elongate tube 12 made of steel, which is typically in the order of 2 m long, but whose length can vary from 1 to 5 m depending on the particular application. The tube 12 is split longitudinally along its length. The split 14 extends along the length of the tube. The tube tapers at the leading end 16 of the bolt. The tapered end 16 makes it easier to insert the tube into a pre-drilled bore. At the proximal end, a domed ring 18 is fixed to the tube by a weld 20. In the drawings where features of the various embodiments are the same, the same reference numbers are used.

With reference to FIGS. 1*a* to 3*b* and FIGS. 7 and 8, an insert 30, also made of steel, is located inside the split tube 12 and extends for substantially the full length of the tube 12 from the proximal end as far as the start of the leading end 16 where the tube begins to narrow and taper. The external diameter of the insert is the same size or more typically slightly larger than the internal diameter of the friction bolt tube 12 so that it contacts the interior of the split tube 12. With reference to FIGS. 3*a* and 3*b* the insert 30 is, like the tube 12, also a cylindrical tube which defines a longitudinal split. As shown in FIG. 1*a*, the split subtends and angle of about 60° to 70° although the size of the split may vary. The insert 30 may be fixed in position in the friction bolt tube 12 or may rely on friction between it and the friction bolt due to the tight fit between the two to keep it is position in the tube 12. As can be seen from FIG. 1*a*, it is preferred that the splits in the tube 12 and the insert 30 are aligned/coincident, although the splits do not have to be aligned, or even overlap, with each other.

FIGS. 4*a* to 6*b* and FIGS. 8 to 10 show a second embodiment of the present invention in which two shorter inserts, 40 and 42, are located in the tube 12. These provide a more localised increase in friction where the inserts are located. The system may use more than two inserts, and the length and location of the inserts may be varied to suit the rock conditions and installation requirements.

Advantageously, with reference to FIGS. 11 to 15, the installation procedure is the same as for a standard friction bolt. In the first stage, a borehole 50 is drilled into the rock 60. The diameter of the borehole 50 is slightly less than the external diameter of the friction bolt. The friction bolt 10, including the insert 30 or inserts 40, 42, is inserted through a bearing plate 70 facing the excavation face 80, into the pre-drilled borehole 50, typically using percussive force to hammer the friction bolt 10 into the borehole 50. Once the friction bolt 10 is fully inserted, the domed head abuts the bearing plate 70 located over the entry to the borehole 50 and no further action is required.

Figure 11:
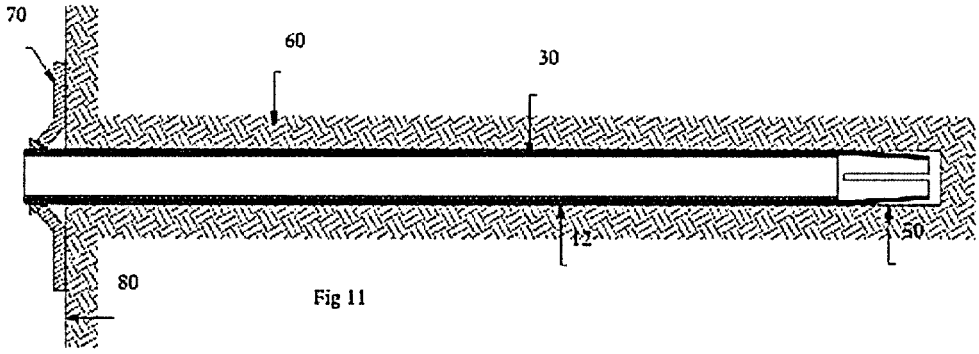
FIG. 11 shows a full length sectional view of the friction bolt embodiment shown in FIGS. 1*a* and 1*b* installed in rock.
Figure 12:
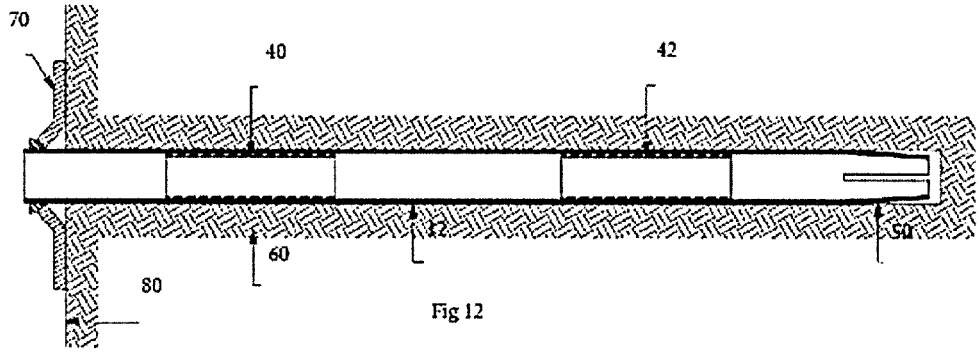
FIG. 12 shows a full length sectional view of the friction bolt embodiment shown in FIGS. 4*a* and 4*b* installed in rock.
Figure 13:
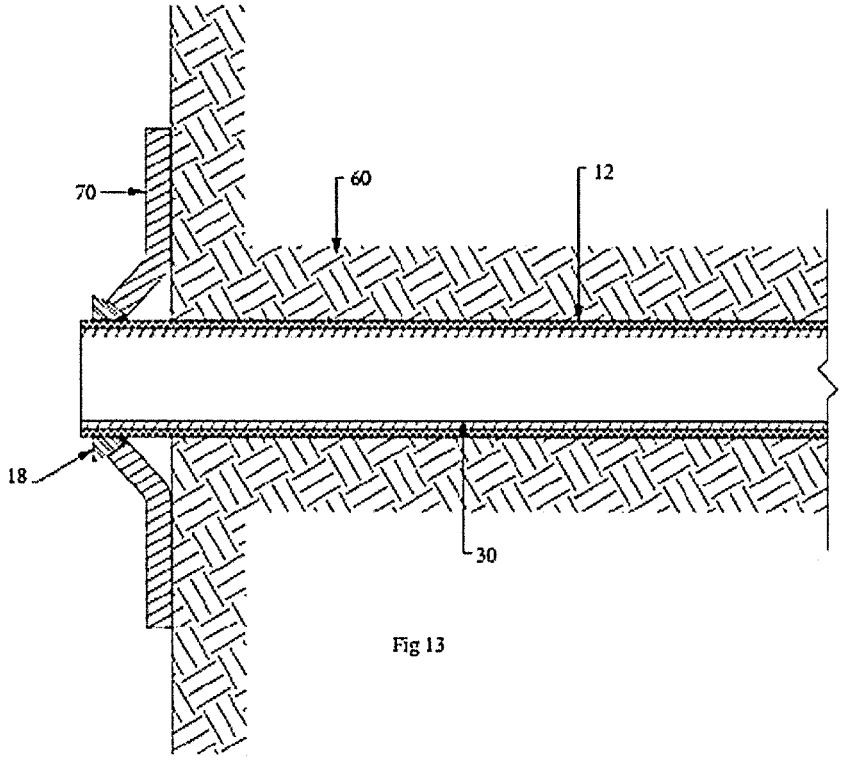
FIG. 13 shows an enlarged view of the proximal end of the friction bolt shown in FIG. 11.
Figure 14:
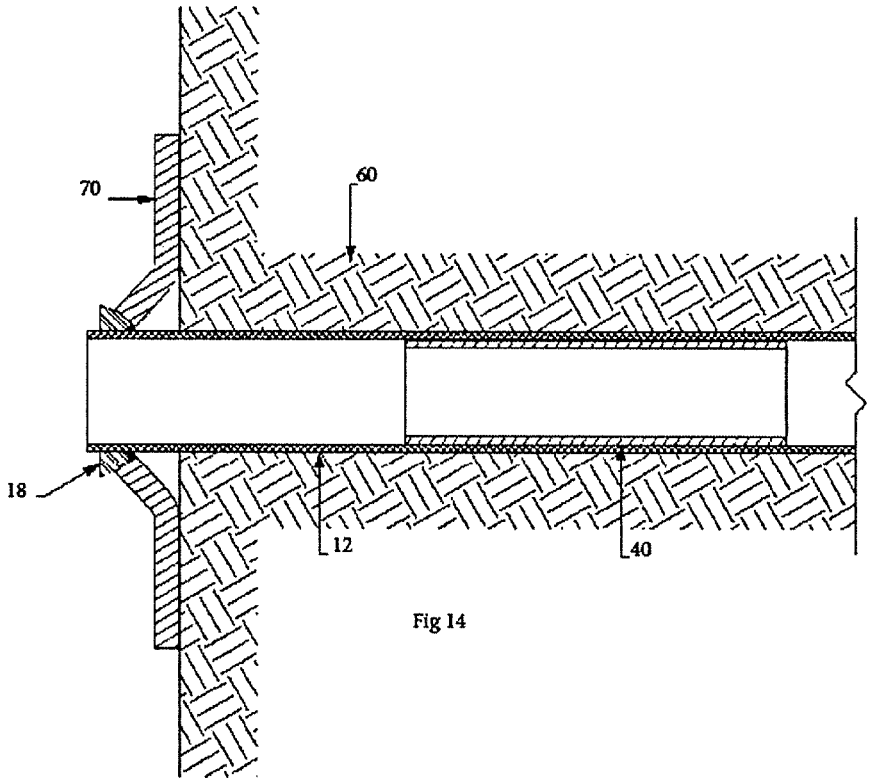
FIG. 14 shows an enlarged view of the proximal end of the friction bolt shown in FIG. 12.
Figure 15:
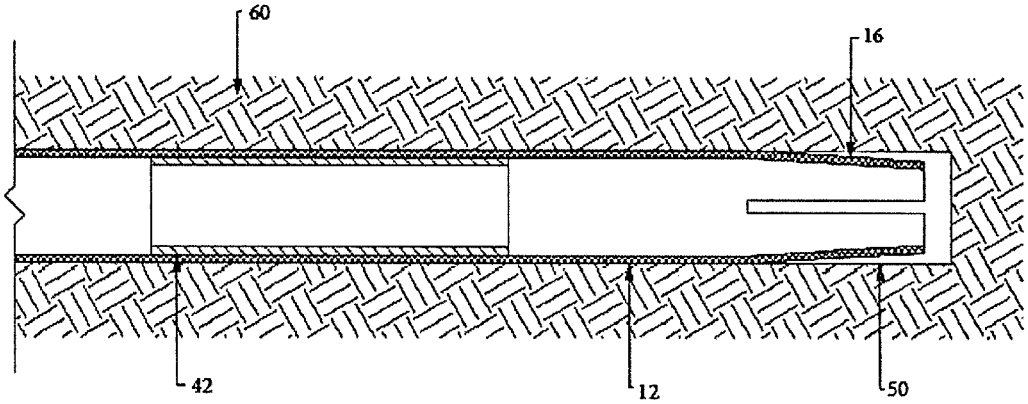
FIG. 15 shows an enlarged view of the distal end of the friction bolt shown in FIG. 12.

FIGS. 11 and 13 show a rock bolt with a full length insert 30. FIGS. 12 and 14 and 15 show a rock bolt with the two shorter inserts 40 and 42.

Figure 16:
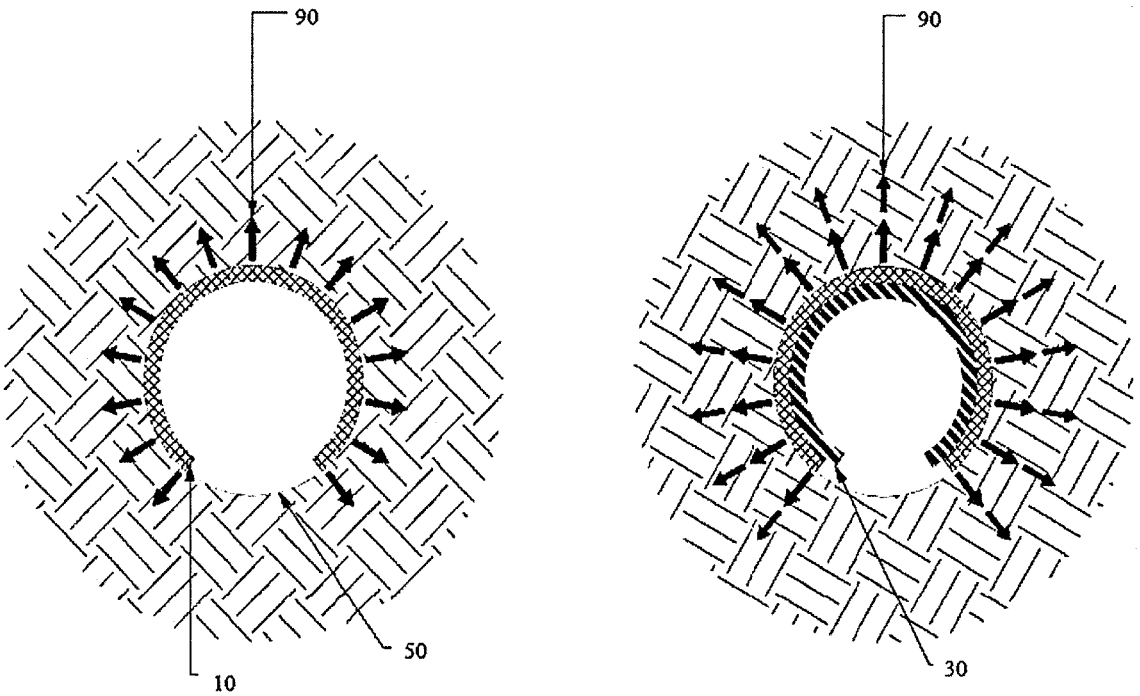
FIG. 16 shows sectional views illustrating the function of the invention.

FIG. 16 illustrates the principals of the invention. On the left is a standard rock bolt 10 with no insert located in a borehole 50, which relies on compression of the split tube 12 to create radial pressure on the walls of the bore, which creates static friction and resistance to movement of the tube in the bore. The radial pressure is indicated by the arrows 90. The right side image shows where the insert 30 is located in the tube 12 of the rock bolt. The inner tube is itself compressed by the split tube 12 and also creates radial pressure which transmits through the split tube 12 to the bore, increasing the radial pressure on the bore and increasing the frictional resistance to movement/withdrawal of the friction bolt.

Typically, the rock bolts will be manufactured and sold with the inserts pre-installed. It is also possible that the inserts may be inserted into the rock bolts on site just prior to insertion into a bore or possibly even after insertion of the rock bolt into the bore.

It will be appreciated by persons skilled in the art that numerous variations and/or modifications may be made to the above-described embodiments, without departing from the broad general scope of the present disclosure. The present embodiments are, therefore, to be considered in all respects as illustrative and not restrictive.

What is claimed is:

1. A friction bolt comprising:

a first generally circular tube having an internal diameter and defining a longitudinal split, the first generally circular tube being radially expandable, the first generally circular tube having a first leading end for insertion into a bore and a second end defining a head; and a second generally circular tube defining a longitudinal split and having an external diameter which is substantially the same as or larger than the internal diameter of the first generally circular tube, the second generally circular tube is located inside the first generally circular tube with an exterior of the second generally circular tube in contact with the interior of the first generally circular tube, wherein the head of the second end of the first generally circular tube extends radially outward from the first generally circular tube, and wherein the second generally circular tube extends for substantially the full length of the first generally circular tube apart from the first leading end.

2. The friction bolt as claimed in claim 1, wherein the longitudinal splits defined in the first and second tubes are substantially coincident.

3. The friction bolt as claimed in claim 1, wherein the second generally circular tube is fixed in position in the first generally circular tube.

4. A method of installing a friction bolt into rock comprising the steps of:

providing a friction bolt comprising:

a first generally circular tube having an internal diameter and defining a longitudinal split, the first generally circular tube being radially expandable, the first generally circular tube having a first leading end for insertion into a bore and a second end defining a head; and a second generally circular tube defining a longitudinal split and having an external diameter which is substantially the same as or larger than the internal diameter of the first generally circular tube, the second generally circular tube is located inside the first generally circular tube with an exterior of the second generally circular tube in contact with the interior of the first generally circular tube, wherein the head of the second end of the first generally circular tube extends radially outward from the first generally circular tube, and wherein the second generally circular tube extends for substantially the full length of the first generally circular tube apart from the first leading end;

inserting the second generally circular tube into the first generally circular tube;

drilling a borehole into the rock, the borehole having an internal diameter which is smaller than the external diameter of the friction bolt; and inserting the friction bolt into the borehole using force to compress the first generally circular tube and the second generally circular tube to create radial pressure on the walls of the borehole.

5. The method of installing a friction bolt as claimed in claim 4, wherein the friction bolt is provided with the second generally circular tube pre-installed in the first generally circular tube.

* * * * *